US010698339B1

(12) United States Patent
Cousoulis et al.

(10) Patent No.: US 10,698,339 B1
(45) **Date of Patent: *Jun. 30, 2020**

(54) COLOR IMAGE DENSITY CALIBRATION IN IMAGING DEVICE HAVING COMMON DEVELOPER VOLTAGE

(71) Applicant: LEXMARK INTERNATIONAL, INC., Lexington, KY (US)

(72) Inventors: Marc Cousoulis, Lexington, KY (US); Gary Scott Overall, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/423,335

(22) Filed: May 28, 2019

(51) Int. Cl.

| | |
|---|---|
| ***G03G 15/08*** | (2006.01) |
| ***G03G 15/00*** | (2006.01) |
| ***G03G 15/16*** | (2006.01) |
| ***G03G 15/01*** | (2006.01) |

(52) U.S. Cl.
CPC ..... *G03G 15/0808* (2013.01); *G03G 15/0115* (2013.01); *G03G 15/0855* (2013.01); *G03G 15/16* (2013.01); *G03G 15/5004* (2013.01); *G03G 15/5037* (2013.01); *G03G 15/5058* (2013.01)

(58) Field of Classification Search
CPC ..... G03G 15/16; G03G 15/0115; G03G 15/0849; G03G 15/0851; G03G 15/0853; G03G 15/0855; G03G 15/5004; G03G 15/5041; G03G 15/5058; G03G 2215/00042
See application file for complete search history.

(56) References Cited

U.S. PATENT DOCUMENTS

| | | | | |
|---|---|---|---|---|
| 9,423,747 | B1 * | 8/2016 | Ishibashi | G03G 15/5008 |
| 2014/0178087 | A1 * | 6/2014 | Suzuki | G03G 15/011 399/50 |
| 2018/0024475 | A1 * | 1/2018 | Tomine | G03G 15/5029 399/55 |
| 2019/0258199 | A1 * | 8/2019 | Kimura | G03G 15/0865 |

FOREIGN PATENT DOCUMENTS

JP 2014182176 A * 9/2014

* cited by examiner

*Primary Examiner* — Carla J Therrien

(57) ABSTRACT

A color imaging device includes a plurality of developer rolls with a common operating point, such as a common operating voltage. To determine the operating point, an acceptable range of color density is determined for each toner, the range being lighter and darker than an optimum color density for that toner. A search range is devised such that values within the range are examined relative to deviations from the optimum color density per each toner. The common operating point is selected as that having the lowest deviation per all toners. Also, if the common operating point corresponds to a color density darker than the acceptable range of color density for any toner, additional halftoning occurs compared to traditional halftoning, such as for continuous tones or solids. In this way, four color developer rolls can be operated from a single power supply, yet still provide acceptable color images.

20 Claims, 5 Drawing Sheets

COLOR IMAGE DENSITY CALIBRATION IN IMAGING DEVICE HAVING COMMON DEVELOPER VOLTAGE

The present disclosure relates to electrophotographic imaging devices having color imaging capability, such as cyan, magenta, yellow and black imaging. It relates further to calibrating image density when developers share a common voltage or other operating point.

BACKGROUND

Color imaging devices contain two or more cartridges. Each transfers a different color of toner to a media sheet as required to produce a full color copy of a toner image. A common imaging device includes four separate color cartridges—cyan, yellow, magenta, and black. Image formation for each of the four colors includes moving toner from a toner reservoir to an imaging unit where toned images are formed on a photoconductive (PC) drum prior to transfer to a media sheet or to an intermediate transfer member (ITM) for subsequent transfer to a media sheet.

In many imaging devices, each color has a dedicated supply of power for setting voltages for charging its PC drum and biasing a developer roll between the toner reservoir and charged drum. In others, power supplies are combined for cyan, magenta and yellow, while black maintains its own dedicated supply. The former provides superior toner usage results and color accuracy. The latter provides economic efficiency. The inventors have identified a need for managing color accuracy and toner usage when all cartridges have but a single common voltage supply.

SUMMARY

A color imaging device includes a plurality of developer rolls with a common operating point, such as a common operating voltage. To determine the operating point, an acceptable range of color density is determined for each toner, the range being lighter and darker than an optimum color density for that toner. A search range is devised such that values within the range are examined relative to deviations from the optimum color density per each toner. The common operating point is selected as that having the lowest deviation per all toners. Also, if the common operating point corresponds to a color density darker than the acceptable range of color density for any toner, additional halftoning occurs compared to traditional halftoning, such as for continuous tones or solids. In this way, four color developer rolls can be operated from a single power supply, for example, yet still provide acceptable color images.

DRAWINGS

DETAILED DESCRIPTION OF THE EMBODIMENTS

Figure 1:
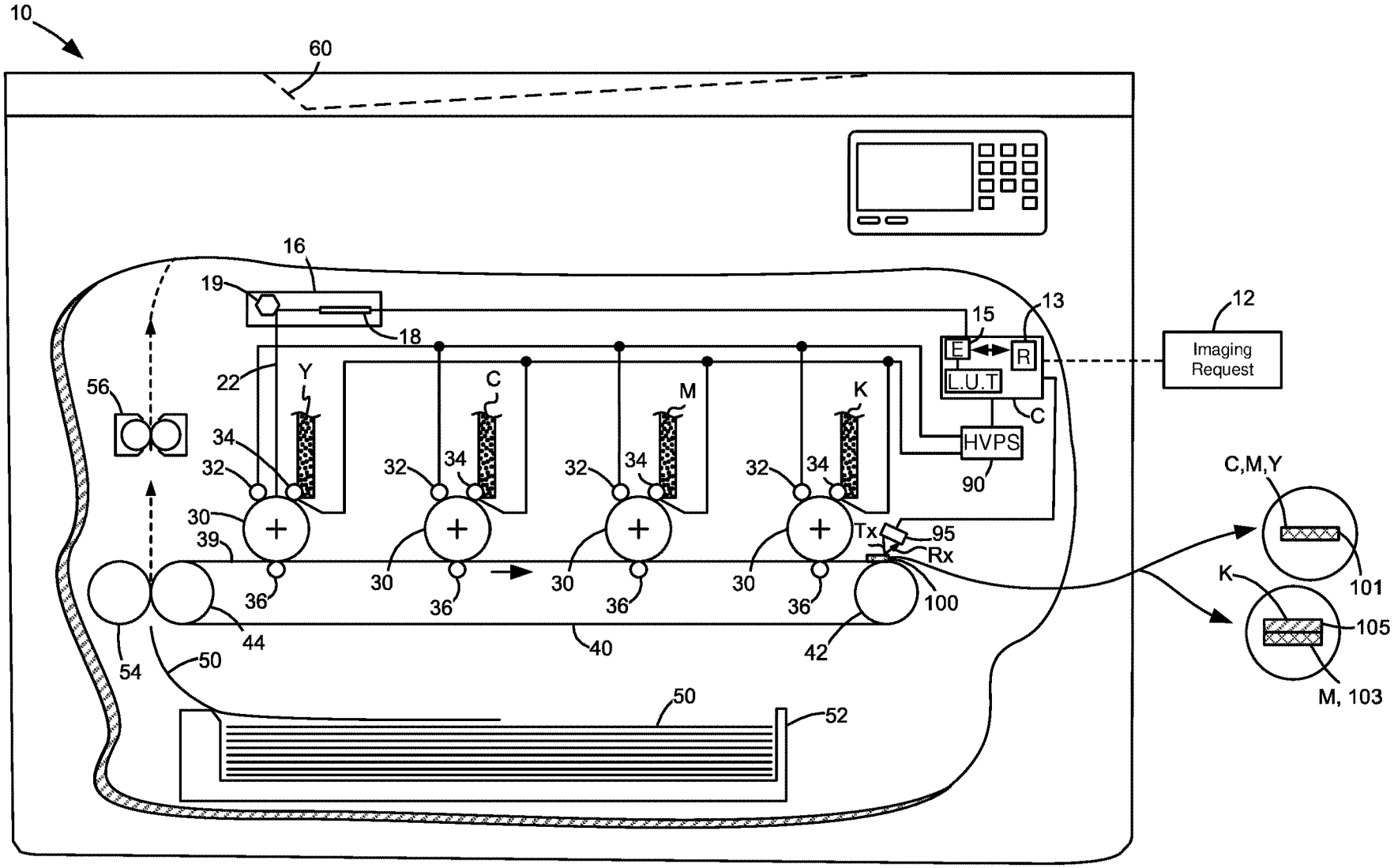
FIG. 1 is a diagrammatic view of an imaging device having color imaging capability and a common developer voltage.

FIG. 1 teaches an imaging device 10 having color imaging capability. The device receives at a controller, C, an imaging request 12. The controller typifies an ASIC(s), circuit(s), microprocessor(s), firmware, software, or the like, and includes a raster image processor (R) 13 and printing engine (E) 15. The request comes from external to the imaging device, such as from a computer, laptop, smart phone, etc. It can also come internally, such as from a copying request. In any, the controller converts the request to appropriate signals for providing to a laser scan unit 16. The unit turns on and off a laser 18 according to pixels of the imaging request. A rotating mirror 18 and associated lenses, reflectors, etc. (not shown) focus a laser beam 22 onto one or more photoconductive drums 30, as is familiar. The drums correspond to supplies of toner, such as yellow (y), cyan (c), magenta (m) and black (k). A corona or charge roller 32 sets a charge on a surface of the drums 30 as the drums rotate. The laser beam 22 electrostatically discharges the drums to create a latent image. A developer roller 34 introduces toner to the latent image and such is electrostatically attracted to create a toned image on a surface of the drums. A voltage differential between the surface of the drums 30 and transfer rolls 36 transfers the toned image from the drums to a surface of an intermediate transfer member (ITM) 40.

The ITM 40, entrained about a drive roll 42 and one or more idler/tension rolls 44, moves in a process direction with the surface of the drums. A sheet of media 50 advances from a tray 52 to a transfer roll 54 where a second difference in voltage between the ITM and the roll causes the toned image to attract and transfer to the media 50. A fuser assembly 56 fixes the toned image to the media through application of heat and pressure. Users pick up the media from a bin 60 after it advances out of the imaging device. The controller coordinates the operational conditions that facilitate the timing of the image transfers and transportation of the media from tray to output bin.

The controller also coordinates with a high voltage power supply 90 to set the relative voltages for the charge rollers 32 and the developer rollers 34. To simplify the hardware configuration, the imaging device includes but a single supply of voltage for the developer rolls as they are all tied commonly to one another that the controller coordinates the voltage value thereof. Input to the controller from a toner patch sensor 95 is also used in this regard. That is, the sensor transmits light (Tx) onto a toner patch 100 and receives reflected light (Rx). For cyan, magenta and yellow, the toner patch is a monochromatic layer 101 of a single color of toner, either c, m, or y. For black toner, appreciating that reflectance cannot be measured in the same manner as the other colors, the toner patch is a dual layer with magenta toner forming a base layer 103 of the toner patch and black toner overlying it, forming an upper layer 105. The amount of reflected light, converted to a voltage by the sensor, indicates a reflectance of the color of the toner and, in turn, a luminance (L*) of the color of the toner (or other metric, such as b-axis for yellow toner), whereas gaps or holes in the coverage of the black toner over the magenta toner allow magenta to reflect back incident light to the sensor thereby indicating an inverse coverage of the black toner. Hereafter, all color toners will be discussed in terms of reflectance for discussion purposes, but appreciating that black toner regards a measurement of the inverse of reflectance sometimes known as an overlay attenuation ratio.

Figure 2:
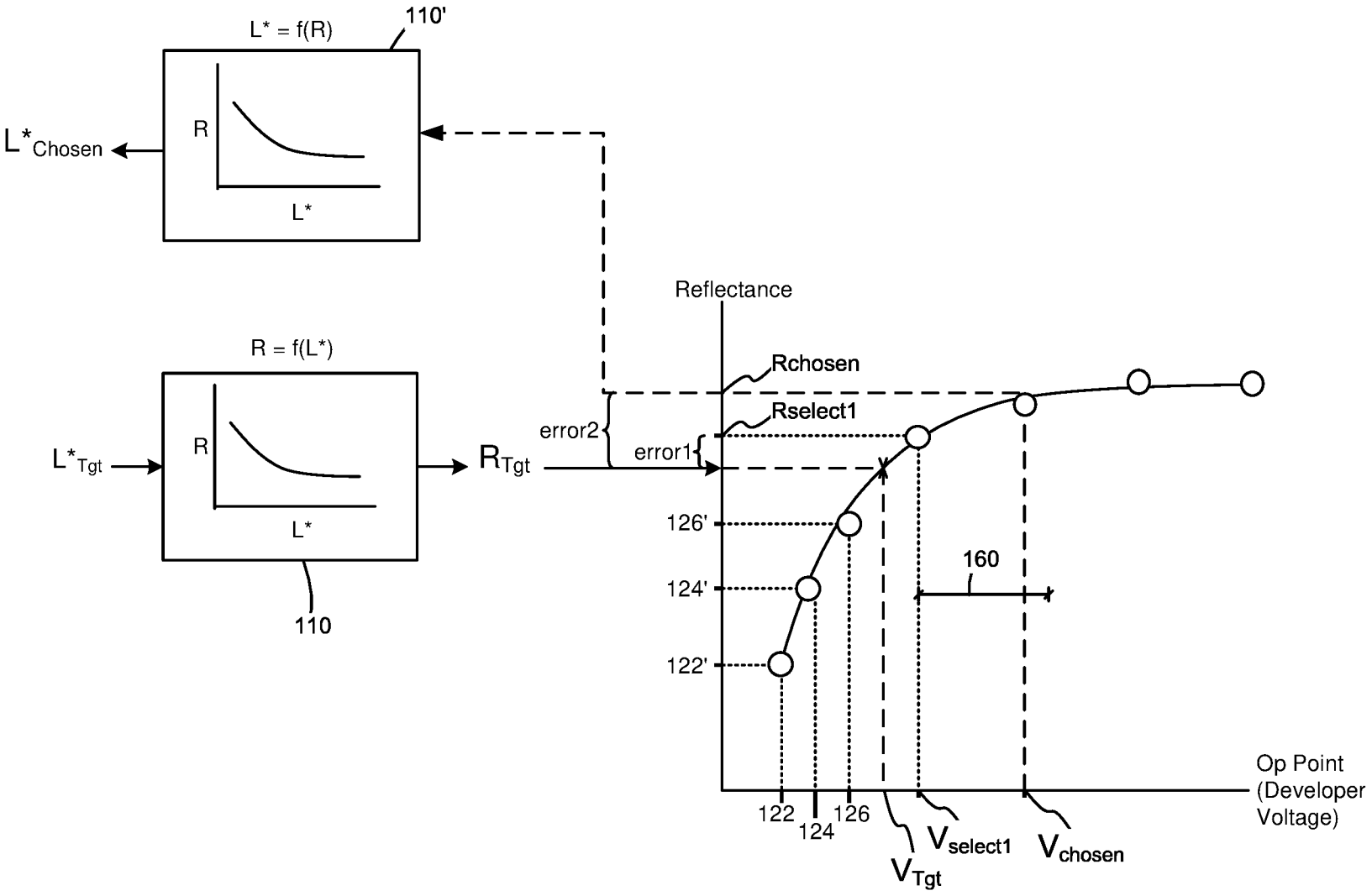
FIG. 2 is a diagrammatic view of an optimized developer voltage per a given color of toner.

With reference to FIG. 2, luminance on media relates to reflectance 110 on the ITM. A desired luminance target ($L^*_{Tgt}$) or operating luminance for each color of toner is known as a function of the properties of the toner and upon empirical testing. The luminance target along with relationship 110 can be stored in memory available to the controller, such as in the look-up-tables (LUT) in FIG. 1, thereby making known to the controller the target reflectance $R_{Tgt}$ for each color of toner. Alternatively, or in addition, the controller can store the desired reflectance ($R_{Tgt}$) for each color of toner. By adjusting various properties of the imaging device and taking measurements during calibration, for instance, operating points in the imaging device can be known that achieve the desired target of reflectance for each color of toner. Some of these operating points include the operating voltage of the developer rolls, the power of the laser to discharge the drums, the operating voltage of the charge rollers setting the charge of the drum, and the like. In the instance of the operating voltage of the developer rolls, each color of toner has a toner patch 100 (FIG. 1) developed on the ITM and its reflectance is measured per a variety of possible voltages. That is, the controller of the imaging device steps the developer rolls, per each color of toner, through voltages from low to high, e.g., 122, 124, 126 and its corresponding reflectance values are measured, e.g., 122', 124', 126'. Eventually, a voltage is found $V_{Tgt}$ that corresponds to the $R_{Tgt}$.

Figure 3:
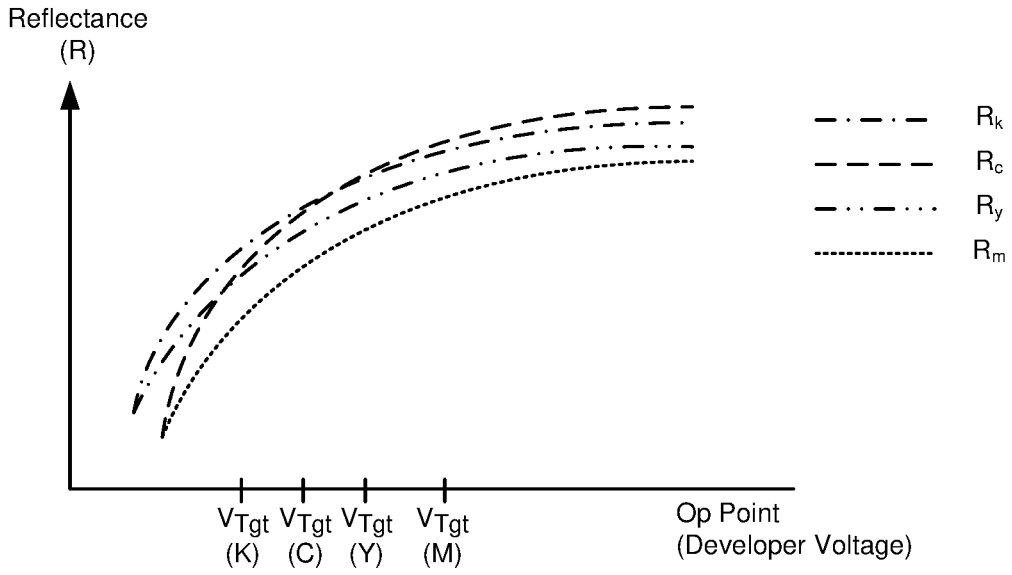
FIG. 3 is a diagrammatic view of optimized voltages for multiple colors of toner showing disparity.
Figure 4:
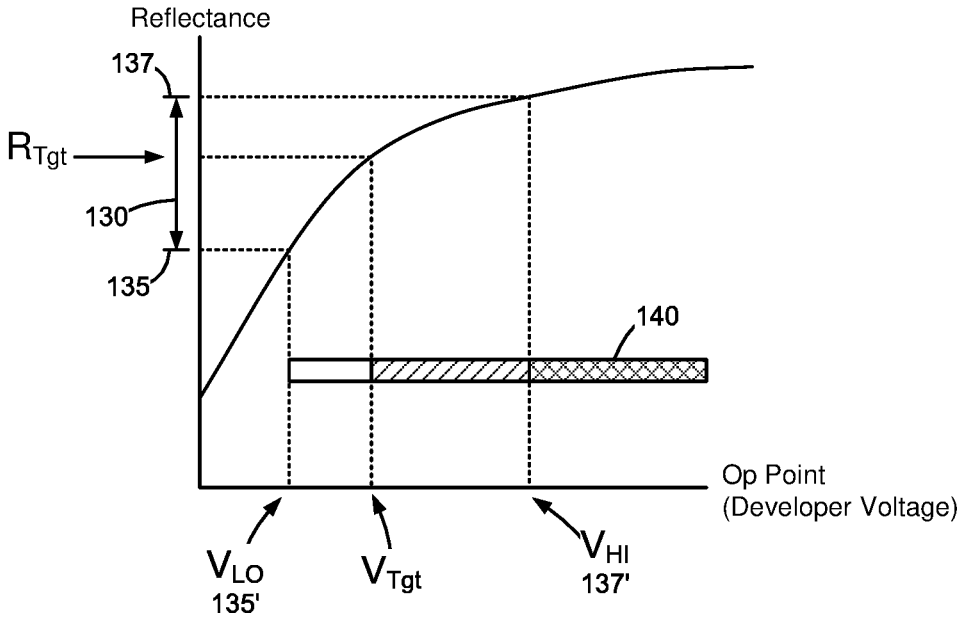
FIG. 4 is a diagrammatic view including an acceptable range of color image density lighter and darker than an optimum color density per a given color of toner.

With reference to FIG. 3, each $V_{Tgt}$ for each color of toner c, m, y, k does not equal one another. However, there must be one single voltage selected for powering the developer rolls as there is but one voltage power supply. To do this, FIG. 4 notes that the $V_{Tgt}$ per any color of toner corresponds to the target reflectance $R_{Tgt}$ of that color and can be defined as the optimum color density for that color. On either side of the optimum color density, an acceptable range 130 of color density is defined through empirical testing for each color. The range 130 includes an acceptable color density that is lighter than optimum 135 and darker than optimum 137. In turn, the lightest acceptable color density corresponds to a voltage condition ($V_{LO}$) that is a lower limit 135' and the darkest acceptable color density corresponds to an upper limit 137' of voltage ($V_{HI}$). Below and above the lower and upper limits, however, the color density of each toner will yield less than satisfying images when printed, especially when the color density corresponds to a reflectance that is darker 140 than the acceptable range. In such instances, a halftoning threshold is reached and halftoning of the color will occur as described below.

Figure 5:
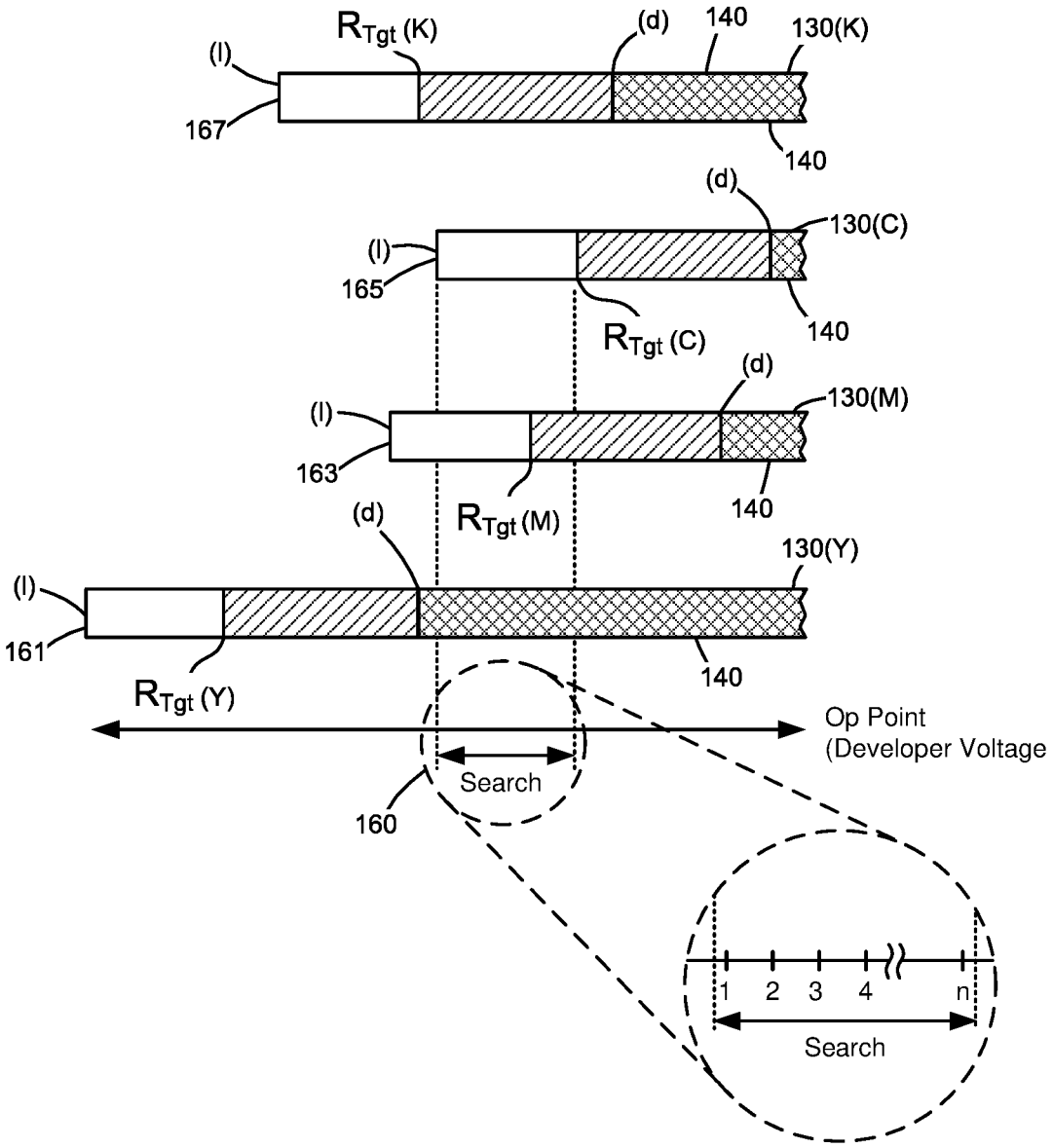
FIG. 5 is a diagrammatic view for selecting the common developer voltage from plural ranges of acceptable color image density for each of the colors of toner.

With reference to FIG. 5, a representative sampling of a plurality of ranges 130 of acceptable color image density are shown for each of the colors of toner c, m, y, k. They range from lighter (l) and darker (d) than the optimum reflectance target ($R_{Tgt}$), including noting color density that is above the dark limit (d) and too dark 140 for the range. To select the single operating point at which the developer rolls will be commonly operated, a search range 160 is first constructed. It extends between a greatest of the lighter of each of the acceptable ranges of color density and a highest target or highest optimum color density in the ranges. As an example, the lighter (l) sides of the ranges 130 are noted at points 161 for yellow toner, 163 for magenta toner, 165 for cyan toner and 167 for black toner. Of these, the highest value or greatest value (rightmost on the graph) is that located at point 165. Next, the targets ($R_{Tgt}$) or optimums for the colored toners are noted at points $R_{Tgt}$(y) for yellow toner, $R_{Tgt}$(m) for magenta toner, $R_{Tgt}$ (c) for cyan toner and $R_{Tgt}$ (k) for black toner. The highest or greatest of these is that located at $R_{Tgt}$ (c). In turn, the search range 160 in this scenario resides between points 165 and $R_{Tgt}$ (c).

Next, the controller examines multiple values or select points (1-n) within the search range to find which point results in the lowest accumulation or summation of error for the entirety of the colors of toners. The points themselves, e.g., 1, 2, 3, 4, . . . n, are selected according to a desired granularity. For example, if the voltage of the developer rollers can be set per every tens of volts, then select points in the search range might be examined similarly. If the voltage range for the developer rolls extends between −300V to −900V (or absolute value |300V| to |900V|) for example, and the search range 160 extends between the voltages |300V| and |500V|, for example, the controller might examine select points |310V|, |320V|, |330V| . . . |490V|, |500V|. Of course, other schemes are possible, but a search range of about 200 volts has been found to be common. Regardless of how fine the points 1-n are examined, each point or voltage in the range results in a corresponding reflectance. As seen back in FIG. 2, for example, if the operating voltage of the search range were noted as the selected voltage ($V_{Select\ 1\text{-}n}$), its corresponding reflectance for that color would be $R_{Select\ 1\text{-}n}$. In turn, between the optimum reflectance $R_{Tgt}$ and $R_{Select\ 1\text{-}n}$ is an error1 of reflectance for each color. The errors for each of the colors are summed together to arrive at a value that is compared to the summation of the errors for each of the colors for each of the select points in the search range. When the lowest summation of errors is found for the entirety of the search range of operating points 1-n, that operating point is selected as the common operating voltage and applied to each of the colors. In FIG. 2, the selected common operating voltage is noted as $V_{Chosen}$ and has a corresponding reflectance noted at $R_{Chosen}$. In turn, an error2 exists between the optimum reflectance and that chosen. Error2 then is used to adjust the color density during an image operation. $R_{Chosen}$ can be also related back to a chosen luminance $L^*_{Chosen}$ in the imagine device, if desired, as the controller knows the relationship 110' between reflectance and luminance.

Also, if the voltage chosen to be the common operating voltage for any given color of toner, $V_{Chosen}$, and its corresponding reflectance $R_{Chosen}$, falls outside the acceptable range of color image density 130 for that color and is darker than the acceptable range, then that color will require halftoning so images will not appear too dark for end users. Thus, a halftone attenuation value is selected from the look up table, that is applied whenever the operating point is too dark for the range. While a number of schemes can be used, the inventors correlate a halftone attenuation percentage to the reflectance error $R_{error}$ based on empirical testing, whereby $R_{error}=R_{Chosen}-R_{Tgt}$, e.g., error2, FIG. 2. In the Table (below), $R_{error}$ is expressed in integer values of 1 corresponding to 1% and it has been found that a typical $R_{Tgt}$ exists around 30% or 30, thus defining the range of the Table. The Halftone Attenuation is expressed as an integer between 0 and 255, whereby 255 represents a halftone attenuation of 100% in which there is no halftone attenuation and 0 represents a fully attenuated image, which is not expected. Other integers are linearly related between 0 and 255. Intuitively, if the $R_{error}$ is zero or very small, such as 0, 1, or 2 in the Table, there is little to no halftone attenuation expected for imaging as the $R_{Chosen}$ will bet the same as the $R_{Tgt}$ or exist very near to it. Conversely, if a large error exists, more halftone attenuation will occur when imaging, such as not when $R_{error}=19$. To the extent the calculation of $R_{error}$ does not correspond exactly to an integer value, schemes can be selected to obtain the halftone attenuation, such as rounding down to the next $R_{error}$ or selecting the closest $R_{error}$.

TABLE

| $R_{error}$ | Halftone Attenuation |
|---|---|
| 0.00 | 255 |
| 1.00 | 255 |
| 2.00 | 255 |
| 3.00 | 235 |
| 4.00 | 230 |
| 5.00 | 225 |
| 6.00 | 220 |
| 7.00 | 216 |
| 8.00 | 212 |
| 9.00 | 208 |
| 10.00 | 204 |
| 11.00 | 201 |
| 12.00 | 198 |
| 13.00 | 195 |
| 14.00 | 193 |
| 15.00 | 190 |
| 16.00 | 188 |
| 17.00 | 185 |
| 18.00 | 183 |
| 19.00 | 181 |

Skilled artisans will also appreciate that there exists four tables in practice, one each for each color of c, m, y and k toner and the halftone attenuation values vary from one table to the next. Also, if the $V_{Chosen}/R_{Chosen}$ exists near to the dark (d) limit for the acceptable range of color density 130, there may be instances below (d) that result in darker images with no halftoning and above (d) with lighter images with halftoning attenuation since $R_{error}$ relates back to the target reflectance, not the dark (d) upper limit on the acceptable range of color density.

In still other embodiments, skilled artisans will appreciate that determining the common operating voltage $V_{Chosen}$ and, in turn, the chosen reflectance $R_{Chosen}$, may require a weighting adjustment as not every color of toner should be considered equally when examining the acceptable ranges of color density 130. That is, region 140 above the upper limit (d) for the yellow toner 130(*y*) need not carry as much weight as other colors when considering halftoning since halftoning yellow does not cause visible artifacts in images. Similarly, it may be desirable to bias the operating point $V_{Chosen}/R_{Chosen}$ closer to the target of the black toner to lessen the chances of needing to halftone black color in images. Still other weighting options can be used to allow various colors to get a larger or smaller vote in selecting the common operating point.

The foregoing description of several methods and example embodiments has been presented for purposes of illustration. It is not intended to be exhaustive or to limit the claims. Modifications and variations to the description are possible in accordance with the foregoing. It is intended that the scope of the invention be defined by the claims appended hereto.

The invention claimed is:

1. In an imaging device with a plurality of developer rolls having a common operating point, a method, comprising:

determining an acceptable range of color density for each toner associated with the developer rolls, each said acceptable range of color density being lighter and darker than an optimum color density for said each toner; and selecting the common operating point from the ranges.

2. The method of claim 1, further including for said each said acceptable range of color density, determining an amount of error from the optimum color density.

3. The method of claim 2, further including summing the amount of error for said each said acceptable range of color density.

4. The method of claim 1, further including defining a search range containing the common operating point.

5. The method of claim 4, wherein the search range exists between a greatest of the lighter of said each said acceptable range of color density and a highest said optimum color density.

6. The method of claim 1, wherein said each toner associated with the developer rolls includes black toner, cyan toner, magenta toner, and yellow toner.

7. The method of claim 1, wherein the selecting the common operating point further includes setting a common voltage for each of said plurality of developer rolls, the common voltage being provided by a single power supply.

8. The method of claim 1, further including creating a patch of toner for said each toner and determining an optical density thereof.

9. The method of claim 8, further including correlating the optical density to an operating point of the developer roll.

10. The method of claim 8, further including correlating the optical density to luminance for said each toner.

11. In an imaging device with a plurality of developer rolls having a common operating point, a method comprising:

determining a first and second acceptable range of color density for first and second toners associated with any of the developer rolls, said first and second acceptable ranges of color density extending between lighter and darker than an optimum color density for said first and second toners;

defining a search range for the common operating point based on each of the first and second acceptable ranges of color density;

for multiple values corresponding to the search range, determining an amount of error from the optimum color density for said each of the first and second acceptable ranges of color density;

summing the amounts of error for each of said multiple values; and selecting as the common operating point within the search range that which has the lowest summation.

12. The method of claim 11, wherein the imaging device has at least four developer rolls, further including determining a third and fourth acceptable range of color density for third and fourth toners associated with said any of the developer rolls, said third and fourth acceptable ranges of color density extending between lighter and darker than an optimum color density for said third and fourth toners.

13. The method of claim 12, wherein the first, second, third and fourth toners correspond to cyan, magenta, yellow and black toner.

14. The method of claim 13, further including defining the search range for the common operating point based on each of the third and fourth acceptable ranges of color density.

15. The method of claim 14, for said multiple values corresponding to the search range, determining an amount of error from the optimum color density for said each of the third and fourth acceptable ranges of color.

16. The method of claim 15, further including summing all said amounts of error for said each of said multiple values.

17. The method of claim 16, further including selecting as the common operating point within the search range the operating point having the lowest summation.

18. The method of claim 13, further including weighting differently the first, second, third and fourth toners when said defining the search range.

19. The method of claim 11, wherein the selecting the common operating point further includes setting a common voltage for each of said plurality of developer rolls, the common voltage being provided by a single power supply.

20. The method of claim 11, further including creating a patch of toner for said each toner and determining an optical density thereof, correlating the optical density to luminance and storing luminance values corresponding to the optimum color density.

* * * * *